United States Patent [19]

Miyazawa

[11] 4,218,636

[45] Aug. 19, 1980

[54] FLUORESCENT DISPLAY DEVICE

[75] Inventor: Hisashi Miyazawa, Mobara, Japan

[73] Assignee: Futaba Denshi Kogyo K.K., Chiba, Japan

[21] Appl. No.: 9,180

[22] Filed: Feb. 2, 1979

[30] Foreign Application Priority Data

Feb. 8, 1978 [JP] Japan ..... 53-12307

[51] Int. Cl.[2] ..... H01J 63/06

[52] U.S. Cl. ..... 315/169.1; 313/497; 315/339; 340/701; 340/781

[58] Field of Search ..... 315/169.1, 169.3, 374, 315/375, 339, 350; 313/496, 497, 503, 510, 467, 468, 469; 340/701, 772, 774, 781

[56] References Cited

U.S. PATENT DOCUMENTS

| | | | |
|---|---|---|---|
| 4,045,702 | 8/1977 | Yasutome et al. | 313/496 |
| 4,081,716 | 3/1978 | Uemura | 313/497 |

*Primary Examiner*—Eugene R. LaRoche

*Attorney, Agent, or Firm*—Oblon, Fisher, Spivak, McClelland & Maier

[57] ABSTRACT

A fluorescent display tube of the triode type having, in a vacuum casing, a filamentary cathode for emitting thermions, and a control electrode for accelerating and controlling the thermions emitted from the cathode, a pattern display section composed of segment anodes each coated with a phosphor layer for emitting light when the thermions impinge thereon, the phosphor layer deposited on the segment anodes being composed of mixed fluorescent materials each having different luminous color and threshold luminous voltage.

10 Claims, 9 Drawing Figures

FLUORESCENT DISPLAY DEVICE

BACKGROUND OF THE INVENTION

1. Field of the Invention

The present invention relates to a fluorescent display device provided with one or more anodes having fluorescent layers deposited on the upper surfaces thereof for luminous display in the form of numerical letters, figures or the like upon impingement of thermions emitted from cathode.

2. Description of the Prior Arts

Conventional fluorescent display devices are provided with a plurality of anodes having fluorescent layers deposited on the upper surfaces thereof and arranged in any suitable pattern depending upon the purpose of display, and adapted to perform luminous display in the form of letters, figures or the like, by impinging thermions emitted from filamentary cathode selectively on the above anodes thereby exciting the fluorescent layers to emit light.

The fluorescent layers deposited on the anodes of the above fluorescent display devices are generally composed of a ZnO:Zn system fluorescent material. Such fluorescent material has several advantages in use such as a very low luminous threshold voltage, that is, a dead voltage as low as about several volts, drivability at a low voltage and easy observation for its green luminous color.

Consequently, the foregoing fluorescent display devices are advantageous in that they can be driven at a low voltage with less power consumption and provide luminous displays which are easy to observe. Thus, the fluorescent display tube has been extensively used in digital display systems such as numerical displays in various types of electronic devices, for example, electronic table computers and digital clocks, frequency indication in wireless units or the like, and in analog display systems such as level indicators in acoustic units, speedometers for vehicles and air crafts, as well as display sections in various instruments. The recent extensive use of the fluorescent display devices requires devices which are capable of emitting luminous colors other than green, or those devices whose luminous colors can be varied portionwise in one display device depending on specified uses. In order to meet with the above requirements, various fluorescent materials for low speed electron ray use have been developed and have come into practical use which can be excited to emit luminous lights under a driving voltage approximately at the same level as that for the ZnO:Zn system fluorescent material. In addition, a fluorescent material of red luminous color consisting of $Y_2O_2S$:Eu or $Y_2O_3$:Eu incorporated with an appropriate amount of $In_2O_3$ or the like to reduce the resistivity for the adaption to the low speed electron ray use, and a fluorescent material of yellow luminous color for low speed electron ray use consisting of ZnS:Mn, Cl incorporated with ZnO or the like have been developed.

The foregoing display devices whose luminous color can be varied portionwise in one device have thus been put to practical use with the advent of those fluorescent materials emitting luminous light of colors other than green under the irradiation of low speed electron rays. A test production has been attempted for those fluorescent display devices in which the above improved fluorescent materials are employed in an analog display device such as a speedometers, so that the display for an excess input or the display for a speed in excess of regulated level is indicated as a color different from that for other display areas to thereby improve the warning effect in the display.

In the above display devices where luminous display regions of different colors are formed portionwise in one display device, however, the respective display regions providing luminous colors are predetermined. Consequently, while the above system having display regions with luminous colors formed portionwise is well suited to analog devices which supply warning effects and information regarding the excess from a regulated level, for example, the level indicator or the speedometer, such system is often inapplicable to fluorescent display devices in which a digital display is produced by means of segmented anodes deposited with the fluorescent layers and arranged in the form of the letter "8". Thus, it is required in the display devices for displaying such numerical letters, figures or the like to vary the luminous color over the entire display pattern not restricted to the specified regions. Highly effective warning operation can be expected also in the analog display device if the luminous colors can be changed for the entire display pattern.

While on the other hand, conventional warning devices generally employed thus far in display devices for analog indication include those using a warning color, generally red or the like, in specified display areas or instruction sections, for example, for numeric values combined with such display areas corresponding to analog display information that require warning, or those adapted to light up warning lamps disposed in combination with or separately from the above warning devices or buzzers.

The conventional warning devices of the foregoing types have, however, several disadvantages. Those adapted to conduct warning by the use of the warning color previously set to the warning means are often inapplicable to the display device employing digital type fluorescent tubes whose application use has rapidly been increased recently, since the warning colors are always displayed. The warning devices utilizing warning lamps or buzzers require additional provision of such lamps or buzzers independent of the display devices and, if the lamps or the buzzers should fail, perform no warning function at all. Moreover, since the warning devices are not always arranged in correspondence with the display sections, retardation may result in response to the warning or unnecessary psychological burdens may be imposed on the driver.

BRIEF SUMMARY OF THE INVENTION

The present invention has been made in view of the foregoing disadvantages in the prior art while taking notice of the fact that dead voltages and driving voltages for attaining effective display brilliancy in fluorescent material are different between the ZnO:Zn system fluorescent material of green luminous color and the fluorescent materials of luminous color other than green such as red and yellow.

Accordingly, it is a primary object of the present invention to provide a fluorescent display device capable of improving the display effect, increasing the amount of display information and providing broader application use for the luminous display, wherein mixed fluorescent layers comprising a mixture of at least two fluorescent materials having different luminous colors and dead voltages are deposited on the anodes and the driving voltage to be applied to the anodes is controlled depending on the purpose of display and the type of information to be displayed, thereby varying the luminous colors of the same anode and thus enabling the luminous colors to be switched both in the analog display as well as in the digital display.

It is another object of this invention to provide a fluorescent display device simple in structure being applicable both to the analog display and the digital display, actuated completely intact with the fluorescent display sections and only when a warning signal arrives, and having a warning function with ensured warning effects, by adapting the driving voltage to be applied to the anodes having the above mixed fluorescent layers upon the application of a warning signal such as for an excess input.

In accordance with the present invention, there is provided a fluorescent display device including one or more anodes having fluorescent substance layers deposited on the upper surfaces thereof for a luminous display in the form of letters, numerical letters figures, symbols or the like upon impingement of thermions emitted from cathodes, and characterized in that at least one of the anodes has mixed fluorescent layers prepared by mixing two or more fluorescent materials having different luminous colors and different threshold luminous voltages from each other. Also provided is a fluorescent display device defined as above, which comprises a switching circuit for the driving voltage for the anodes having the mixed fluorescent layers above described; the switching circuit for the anode driving voltage being adapted to switch the anode driving voltage between at least two voltage levels corresponding to the threshold luminous voltage for each of the fluorescent materials composing the above mixed fluorescent layers.

DETAILED DESCRIPTION OF THE PREFERRED EMBODIMENTS

Now, a fluorescent display device according to the present invention will be hereinafter described by way of example with reference to the accompanying drawings.

Figure 1A:
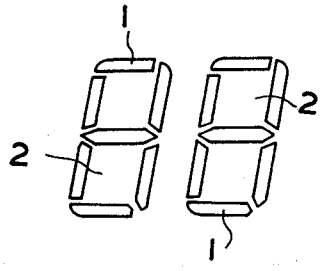
FIG. 1(*a*) to FIG. 1(*c*) respectively show different examples of pattern display sections to be applicable to a fluorescent display device according to the present invention.
Figure 1B:
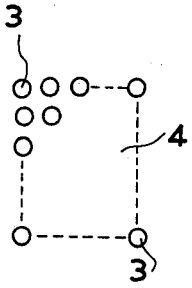
Figure 1C:
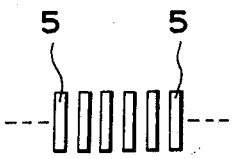

FIGS. 1*a*, 1*b*, and 1*c* illustrate pattern display sections which are respectively different in shape and adapted to be used in the fluorescent display device of the present invention. The pattern display section 2 shown in FIG. 1*a* consists of segment anodes arranged in the shape of the letter "8" to display any one of numerals "0" to "9". A plurality of the pattern display sections are disposed laterally in side by side relationship as shown in FIG. 1*a* or vertically to form multi-digit pattern display sections. The pattern display section 4 shown in FIG. 1*b* comprises dot-shaped or rectangular anodes 3 arranged at a distance in a matrix form, and displays letters or figures by selectively impinging electrons emitted from cathodes on the anodes 3. The pattern display section shown in FIG. 1*c* consists of anodes 5 which are linearly disposed at a distance and display input information as a bar-shaped analog display by illuminating a certain number of the anodes by applying anode voltage which corresponds to the input information.

Figure 2:
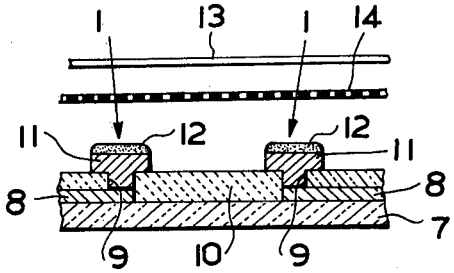
FIG. 2 is an enlarged cross-sectional view of a part of a fluorescent display device according to an embodiment of the present invention.

FIG. 2 is a sectional view of the essential part of the fluorescent display device having the pattern display section 2 shown in FIG, 1*a*. The fluorescent display device shown in FIG. 2 comprises a substrate 7 made of an insulating material such as for example glass or ceramic on which wiring conductors 8 having a predetermined pattern are deposited.

The substrate 7 on which the wiring conductors are deposited is coated with an insulating film 10 having through holes 9 for communicating with the wiring conductors 8. Anode conductors 11 are disposed on the predetermined positions of the insulating film so as to be electrically connected to the wiring conductors 8 through the holes 9 and fluorescent layers 12 are deposited on the upper surface of the anode conductors 11 thereby constituting anodes 1.

One of the essential features of this invention resides in the fluorescent layer 12 deposited on the anode conductors 11. The fluorescent layer 12 consists of a mixed fluorescent layer comprising a mixture of at least two fluorescent materials having different luminous colors and different dead voltages, the details of which will be described hereinafter. Reference numeral 13 designates a filamentous cathode adapted to emit electrons upon heating with electric current. Reference numeral 14 designates a control electrode, for example in a mesh form, disposed between the anodes 1 and the cathode 13 for accelerating and controlling the electrons emitted from the cathode 13. A front cover (not shown) which is transparent at least in a portion opposite to the anodes 1 is sealed to the periphery of the substrate 7 to keep each of the electrodes in a vacuum; and lead terminals for supplying driving voltage to each of the above electrodes are led out through the sealed portion between the substrate 7 and the front cover in an air tight manner, thereby constituting the fluorescent display device.

Reference will now be made to the fluorescent layer 12 to be deposited on the anode conductors 11.

The fluorescent layer 12 is not composed of a single fluorescent material as in conventional fluorescent display devices but comprises at least two fluorescent materials in admixture as described previously. In addition, the fluorescent materials are required to have different luminous colors and different dead voltages from each other.

The combination of such fluorescent materials include the following. For luminous colors of red and green, a ZnO:Zn system fluorescent material of green luminous color having about 1–2 V of dead voltage may be mixed in an appropriate mixing ratio with a $Y_2O_2S$:Eu system fluorescent material of a red luminous color treated for low speed electron ray use and having about 20 V of dead voltage. For luminous colors of blue and red, ZnS:AgCl system fluorescent material of blue luminous color having about 10 V of the dead voltage and subjected to the treatment for low electron ray use may properly be mixed with the above $Y_2O_2S$:Eu system fluorescent material. A fluorescent display device capable of providing red, green and blue luminous colors can be realized by properly mixing the foregoing three types of the fluorescent materials together.

The mixed fluorescent materials prepared by mixing at least two of the above fluorescent materials are deposited on the upper surface of the anode conductors 11 as shown in FIG. 2.

The above deposition can be effected by conventional methods employed for depositing single fluorescent material on the anode conductor, for example, precipitating method, printing method or electrodeposition. When depositing the fluorescent layer 12, for example, through electrodeposition, a solution for electrodeposition is prepared by charging the above fluorescent material mixture in an organic solvent such as ethanol, methanol and isopropanol and adding a small amount of electrolytes such as $Mg(NO_3)_2$, $An(NO_3)_2$, $Al(NO_3)_3$ or the like. The substrate 7 on which the anode conductor 11 is formed is immersed into the above electrode-position solution and electrodeposition is carried out while applying a potential utilizing the anode conductor 11 as the negative electrode to thereby deposit the upper surface of the anode conductor 11 with the fluorescent layer 12.

The fluorescent layer 12 thus deposited on the anode conductor 11 as described hereinabove includes particles of at least two or more fluorescent materials mixed together. Electrons emitted from the cathodes heated through a current supply are impinged upon each of these fluorescent materials.

The dead voltage for each of the fluorescent materials composing the above mixed fluorescent layer 12 is different from each other as described hereinabove. Thus, if the fluorescent layer 12 consists of two fluorescent materials whose dead voltages are $V_1$ and $V_2$ respectively (where $V_1 < V_2$), and the anode voltage applied to the anode conductor 11 is gradually increased to exceed the dead voltage $V_1$, one of the fluorescent materials having the lower voltage emits luminous color at first. The luminous color emitted from this material can be observed while the anode voltage is kept below the dead voltage $V_2$ since only this fluorescent material emits luminous light in the fluorescent layer 12.

Then, if the anode voltage is further increased to exceed the dead voltage $V_2$, the other fluorescent material now begins to emit light and luminous colors from these two types of the fluorescent materials can be observed in admixture.

However, when the anode voltage to the anode conductor 11 is further increased above the dead voltage $V_2$, the luminous brilliancy of one of the fluorescent materials having the lower dead voltage tends to saturate, while the luminous brilliancy of another fluorescent material having the higher dead voltage is increased as the anode voltage increases. Thus, the relative luminous intensity of the latter material is increased. Consequently, if the anode voltage exceeds the dead voltage $V_2$, luminous color from the latter fluorescent material becomes predominant over that of the former and only the luminous color from the latter fluorescent material is now substantially observed in place of that from the former under such a high anode voltage.

Accordingly, the luminous color on the same anode 1 can be varied by the control of the anode voltage.

Figure 3:
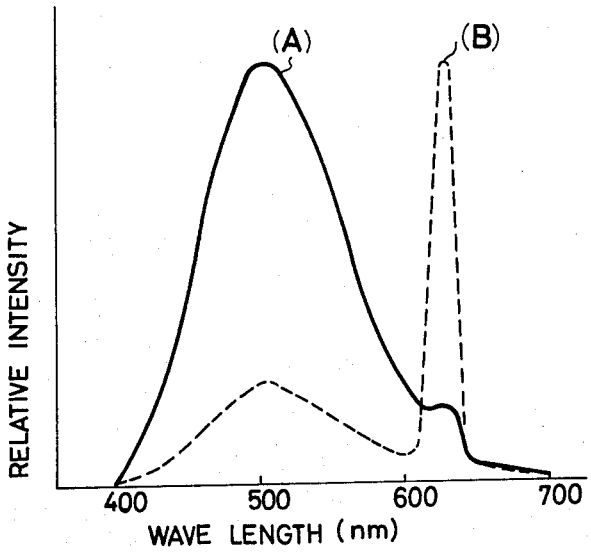
FIG. 3 is a diagram showing luminous characteristics of the fluorescent display device shown in FIG. 2.

FIG. 3 is a diagram showing a luminous spectrum in relation to the change of anode voltages, where the anode 1 is formed of the anode conductor 11 and a mixed fluorescent layer 12 prepared by mixing two fluorescent materials of ZnO:Zn system and $Y_2O_2S$:Eu system in an appropriate mixing ratio.

In FIG. 3, the wavelength of luminous lights and the relative luminous intensity are expressed on the abscissa and the ordinate respectively, in which the relative luminous intensity is given by standardizing the luminous intensity at each of the wavelength for the luminous light with the maximum peak value at each of the anode voltages.

The solid curve (A) in FIG. 3 corresponds to about 20 V of the anode voltage, where the peak value for the luminous intensity is located near 504 nm and green luminous light characteristic to ZnO:Zn system fluorescent material is predominant, while the luminous color derived from $Y_2O_2S$:Eu system fluorescent material can scarcely be observed.

The dotted curve (B) in FIG. 3 corresponds to the anode voltage increased to about 60 V, where the luminous spectrum has its maximum peak value near 630 nm since the anode voltage is greatly in excess of the dead voltage for the $Y_2O_2S$:Eu system fluorescent material. Although the ZnO:Zn system fluorescent material is also excited by the electrons to emit luminous color thus showing a little peak near 504 nm in this case, the peak value is much lower than the peak value near 630 nm and, consequently red luminous color characteristic to $Y_2O_2S$:Eu can substantially be observed.

At the anode voltage between the above 20 V and 60 V, a luminous color can be observed which is a mixture of the luminous color from the ZnO:Zn system fluorescent material and that from the $Y_2O_2S$:Eu system fluorescent material respectively having specified luminous intensities corresponding to that voltage value.

Thus, the luminous color on the same anode 1 can be varied by preparing the fluorescent layer 12 to be deposited on the anode conductor 11 from at least two fluorescent materials in admixture respectively having different luminous colors and different dead voltages from each other and by changing the anode voltage.

Accordingly, when effecting luminous display for letters, numerals and the like by the pattern display sections shown in FIG. 1(*a*) or (*b*), the kind of information that can be displayed in one display device can be increased drastically and the input information to be displayed can be clearly and easily distinguished by changing the luminous colors of the display sections depending on the type of the input information, for example, the current value in green and the voltage value in red.

Furthermore, in the pattern display sections as shown in FIGS. 1(*a*) to (*c*), the warning effect in a digital display system or an analog display system, for example, in a level meter or a speedometer, can be much improved by adapting to vary the color of the luminous anodes 1, 3 and 5 in case the input information should exceed a predetermined level.

In the foregoing embodiment, it will be apparent that the anodes having mixed fluorescent layers prepared by mixing at least two fluorescent materials having different luminous colors and different threshold luminous voltages from each other may be arranged in the fluorescent display device in the form of one or more anodes or parts of anodes while constituting the remaining anodes with fluorescent layers consisting of a single fluorescent material. Such a fluorescent display device comprising first anodes having fluorescent layers consisting of a single fluorescent material and second anodes having mixed fluorescent layers consisting of at least two fluorescent materials suitably combined to each other has a further excellent unique function in that it is capable of producing complicated luminous displays in the combination of two or more luminous colors by driving the second anodes with the anode voltage selectively varied.

The fluorescent display device according to the another embodiment of this invention will be hereinafter described with reference to FIGS. 4 through 7.

Figure 4:
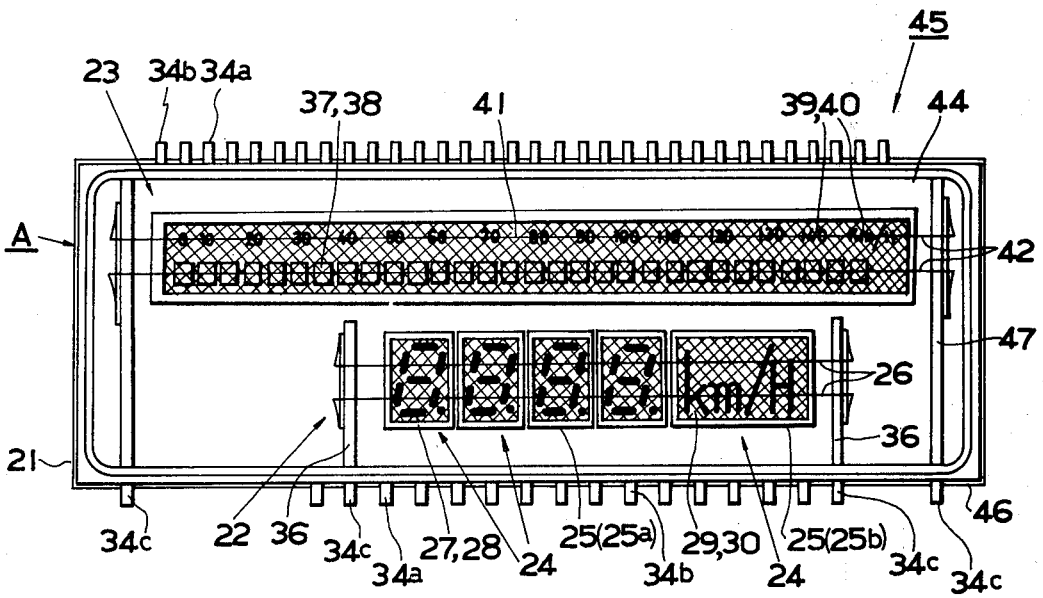
FIG. 4 is a plan view of a fluorescent display device according to another embodiment of the present invention.
Figure 5:
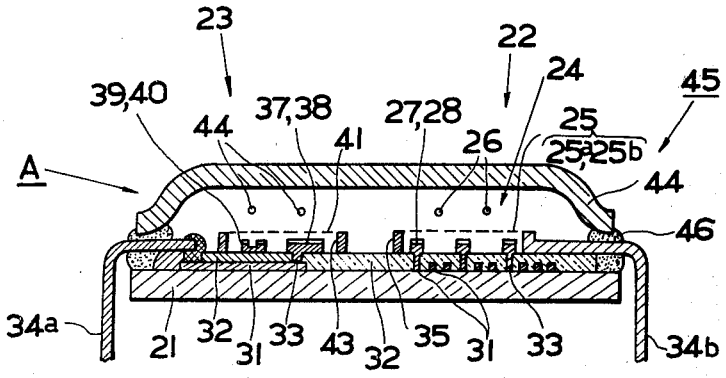
FIG. 5 is a vertical cross-sectional view of the fluorescent display device shown in FIG. 4.
Figure 6:
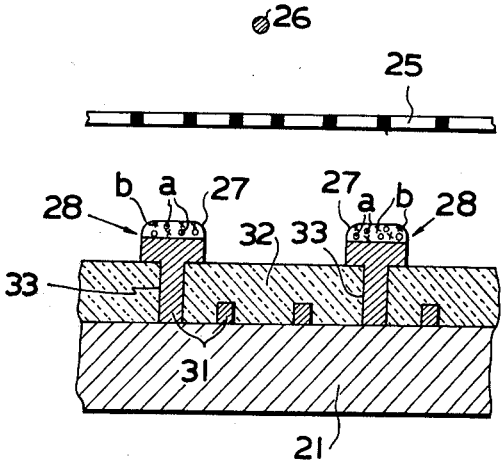
FIG. 6 is an enlarged cross-sectional view for a part of the fluorescent display tube shown in FIG. 4.
Figure 7:
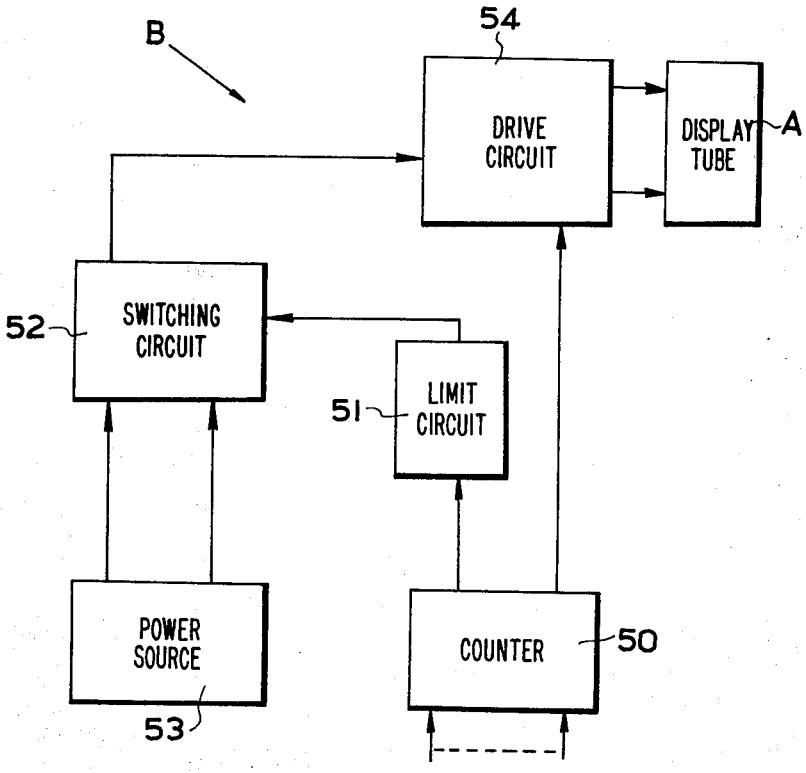
FIG. 7 is a diagram for switching anode voltage for the fluorescent display device as shown in FIG. 4.

The fluorescent display device of this embodiment is used for a vehicle speedometer having a warning function and comprises a fluorescent display tube shown in FIGS. 4 through 6 and a switching circuit for driving voltage shown in FIG. 7. Reference is now made to FIGS. 4, 5, and 6, which are a plan view, a sectional view and an enlarged sectional view, respectively showing the fluorescent display tube according to the present invention.

Reference numeral A generally designates a fluorescent display tube which is applied to a speedometer for a vehicle. The fluorescent display tube according to this embodiment comprises a substrate 21 made of an insulating material such as glass or ceramic, a digital display section 22 and an analog display section 23, respectively, arranged on the same upper surface of the substrate 21.

The digital display section 22 consists of a plurality of pattern display sections 24 located side by side, a control electrode 25 located above and opposite to each pattern display section 24, and cathode 26 located over and opposite to the pattern display sections 24 and the control electrodes 5.

Each of the pattern display sections 24 consists of a group of a plurality of segment anodes 28, each having a fluorescent layer 27 thereon, said group being so formed that it can selectively display a plurality of characters, figures or the like (FIG. 4 shows a pattern with letter 8 in addition to a point), and/or pattern anodes 30, each having a fluorescent layer 29 thereon and disposed to represent a unit or the like of a figure displayed by the segment anodes 28. The pattern display sections or columns 24 are located on the base plate 21 in a laminated manner with a wiring film layer 31 and an insulating film layer 32 therebetween.

One of the essential features of this invention resides in the fluorescent layers 27 and 29 comprising mixed fluorescent layers prepared by mixing at least two fluorescent materials (a) and (b) having different luminous colors and different dead voltages from each other. Since the composition and the effects of the fluorescent layers 27 and 29 are substantially the same as those described with reference to FIGS. 1 to 3, explanation will not be made as to these layers.

The wiring film layer 31 electrically connects the corresponding common segment anodes 28 and/or pattern anodes 30 of each column 24 through connection holes 33 provided in the insulating layer 32 and, in addition, it is electrically connected to each of the anode terminal lead-in wires 34*a* introduced from the outside.

The control electrodes 25 (25*a* and 25*b*) are provided for the respective pattern display sections or columns 24 to control or accelerate electrons emitted from the cathode 26 toward the groups of segment anodes 28 and pattern anodes 30 of the pattern display sections 24. In addition, the control electrodes 25 (25*a* and 25*b*) are formed, for instance, of fine meshes, in order to clearly observe the fluorescent display of the segment electrodes 28 and pattern electrodes 30 from the above, are fixed at predetermined positions through grid supports 35, and are connected to each of the grid terminal lead-in wires 34*b* introduced from the outside.

The cathode 26 is formed of a fine filament-like wire made of high melting point metal such as tungsten, coated with a coating material high in electron emission efficiency, which is stretched over and opposite to the pattern display sections 24 and control electrodes 25 and which is fixed by filament supports 36, which are connected to cathode terminal lead-in wires 34*c* introduced from the outside.

The analog display section 23 consists of a plurality of dot anodes 38 linearly arranged side by side so as to selectively give a dot-shaped or bar-shaped fluorescent display in the longitudinal direction with each dot anode having a fluorescent layer 37 thereon. Pattern anodes 40 are located on the same surface as the dot anodes 38 in the vicinity thereof and are adapted to have patterns of characters and the like representing the number, quantity or the like of the fluorescent analog display given by the dot anodes 38, each pattern anode having a fluorescent layer 39 thereon. A control electrode 41 is located above and opposite to the dot anodes 38 and pattern anodes 40, and a cathode 42 is stretched over the control electrode 41.

The fluorescent layers 37 and 39 constitute, in the same manner as that for the fluorescent layer 27 and 29, one of the essential features of the present invention and consist of a mixed fluorescent layer prepared by mixing at least two fluorescent materials having different luminous colors and different dead voltages from each other. Since the composition and the effects are the same as those of the mixed fluorescent layer described with reference to FIGS. 1 through 3, the detail explanation will not be made as to these layers.

The dot anodes 38 and the pattern anodes 40 are located on the base plate 21 in a laminated manner with the wiring films 31 and the insulating film layer 32 therebetween. Each of the dot anodes 38 and pattern anodes 40 is electrically connected to the corresponding wiring film 31 through the corresponding connection hole 33 and further to a corresponding anode terminal lead-in wire 34*a* introduced from the outside. If a plurality of the pattern anodes 40 are allowed to be simultaneously energized for display, the pattern anodes may be electrically connected with one another by a conductive film layer made of the same material as the anode 40, on the upper surface of the insulating film layer 32 on which the wiring films 31 or the pattern anodes 40 are provided; and further to a single or a small number of anode lead-in wires 34*a* introduced from the outside. In addition, the pattern anodes 40 may be electrically connected to the pattern anodes 30 of the digital display section 24.

The control electrode 41 is arranged so that it may be positioned above and opposite to all the dot anodes 38 and pattern anodes 40 in common. The control electrode, which controls or accelerates electrons emitted from the cathode 42 toward the dot anodes 38 and the pattern anodes 40, is formed, for instance, of fine meshes so as to insure clear observation from the above, is fixed to the predetermined position through grid supports 43, and is electrically connected to a grid terminal lead-in wire 34b introduced from the outside.

As in the case of the cathode 26 of the digital display section 22, the cathode 42 is preferably formed of a filament-like fine wire made of high melting-point metal coated with a coating material high in thermion emission efficiency and is supported in tension above and opposite to the dot anodes 38, pattern anodes 40 and control electrode 41 by filament supports 47 connected to cathode terminal lead-in wires 34c introduced from the outside.

Reference numeral 44 designates a cover plate framed with side portions as shown and being transparent at least at the portions positioned opposite to the digital display section 22 and analog display section 23. A casing 45 is formed of the base plate 21 and the cover plate 44 air-tightly bonded together at the edge portions thereof with low melting-point frit glass or the like, and is adapted to contain the digital display section 22 and analog display section 23 provided on the base plate 21. Each of the terminal lead-in wires 34a, 34b and 34c connected to the respective anodes and electrodes provided on the base plate 21 are airtightly passed through the sealed portion 46 of the casing 45 between the phase plate 21 and the cover plate 44. Thus, when power is supplied to the respective anodes and electrodes inside the casing 45 through the terminal lead-in wires introduced from the outside of the casing, the digital display section 22 and the analog display section 23 can be activated.

FIG. 7 is a switching circuit for the driving voltage for the fluorescent display tube A. The switching circuit generally indicated by the reference numeral B consists of a counter 50, a variable limit circuit 51, a switching circuit 52, a drive power source 53 and a drive circuit 54.

In the above switching circuit, when a signal value for the data input (signal value for the vehicle speed in this embodiment) exceeds a predetermined limit value set in the variable limit circuit 51, the variable limit circuit 51 actuates to send a high voltage switching signal to the switching circuit 52, which in turn conducts a switching operation upon this signal to switch the power source voltage to a high voltage, whereby the driving voltage, specifically the anode voltage for the above fluorescent display tube A, is switched to a predetermined high voltage by way of the drive circuit 54.

To the contrary, if the signal value for the data input is below the predetermined limit value set in the above variable limit circuit 51, the variable limit circuit 51 actuates to send a low voltage switching signal to the switching circuit 52, which in turn conducts a switching operation to switch the driving voltage for the fluorescent display tube A to a predetermined lower voltage.

In fluorescent display tubes in which anodes are prepared by mixing a ZnO:Zn system fluorescent material (a) of green luminous color with a $Y_2O_2S$:Eu system fluorescent material (b) of red luminous color in an appropriate mixing ratio and depositing the mixture on anode conductors as a mixed fluorescent layer in order to effect warning function, for example, as in the fluorescent display tube A in this embodiment, the limit value for the data input of the vehicle speed is set by the variable limit circuit 51 in the switching circuit B, for example, to 120 km/hr, to thereby set the anode driving voltage as the power source voltage to be switched by the switching circuit 52 to 20 V for the data input value below the predetermined limit value and to 60 V for the data input value in excess of the above predetermined limit value. Then, when the vehicle speed is at an ordinary speed, for example, below 130 km/hr, the anodes in each of the display sections in the fluorescent display tube A show green luminous color; but when the vehicle speed exceeds, for example, 120 km/hr, the color of the anodes in each of the display sections entirely turns to a red warning color to provide an warning function as well as an indication of the speed on the display sections.

If the fluorescent display tube A has several display sections on its display surface as in the above embodiment, the mixed fluorescent layers for effecting the warning function may be provided on only one of the display sections while the other fluorescent display sections are provided with the usual fluorescent layer having no warning function.

Furthermore, if a plurality of display compartments such as a numerical section and a unit indication section, or a dot section and a scale section are provided together in one kind of the display section as in the foregoing embodiment, only one of the display compartments may be formed by the mixed fluorescent layers.

It should be understood that the fluorescent display device according to the present invention can be applied not merely to the speed display device as in the foregoing embodiment but also to various types of other digital or analog display devices including those for rotational speed, height, pressure, fuel level or the like, as well as level indicator for audio units, so long as they are display devices utilizing a fluorescent display tube.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A fluorescent display device comprising:

a vacuum casing made up of a substrate and a front cover bonded to each other;

an insulating layer formed on said substrate;

a filamentary cathode provided in said vacuum casing for emitting thermions when energized and heated;

a control electrode provided in said vacuum casing for accelerating and controlling the thermions emitted from said filamentary cathode; and a pattern display section composed of a plurality of anodes each coated with a phosphor layer for emitting light when the thermions impinge thereon, said phosphor layer being composed of mixed fluorescent materials each having different luminous color and threshold luminous voltage.

2. The fluorescent display device as defined in claim 1, wherein said pattern display section is composed of segment anodes arranged in the form of the figure "8" for performing luminous display of a plurality of numerals by selectively actuating each of said segment anodes.

3. The fluorescent display device as defined in claim 1, wherein said pattern display section is composed of dot anodes arranged in a matrix form for performing luminous display of a plurality of numerals, letters, and symbols by selectively actuating each of said dot anodes.

4. The fluorescent display device as defined in claim 1, wherein said pattern display section is composed of dot-shaped and/or bar-shaped anodes linearly arranged having a predetermined space therebetween for performing analog display of an input information by actuating a certain number of said anodes corresponding to the input information.

5. The fluorescent display tube as defined in claim 1, wherein said pattern display section is divided into a digital display section having segment anodes in the form of the figure "8" and an analog display section having dot anodes disposed along a line for performing analog display of an information represented by said digital display section and said phosphor layer deposited on at least either one of said display sections is composed of the mixed fluorescent materials.

6. The fluorescent display device as defined in claim 1, 2, 3 or 4, wherein said mixed fluorescent materials are composed at least of a ZnO:Zn system fluorescent material and a $Y_2O_2S$:Eu system fluorescent material.

7. The fluorescent display device as defined in claim 1, 2, 3 or 4, wherein said mixed fluorescent materials are composed at least of a ZnS:AgCl system fluorescent material and a $Y_2O_2S$:Eu system fluorescent material.

8. The fluorescent display device as defined in claim 1, 2, 3 or 4, wherein said mixed fluorescent materials are composed at least of a ZnO:Zn system fluorescent material, a $Y_2O_2S$:Eu system fluorescent material and a ZnS:AgCl system fluorescent material.

9. The fluorescent display device as defined in claim 1 further comprising a switching circuit for changing anode voltage into at least two levels so as to correspond to the threshold luminous voltage for each of said mixed fluorescent materials, whereby the luminous color of said mixed fluorescent materials is turned by switching the anode voltage.

10. The fluorescent display device as defined in claim 9, wherein said switching circuit comprises a counter, variable limit circuit, switching circuit, power source and driving circuit.

* * * * *